US008237589B2

(12) United States Patent
Lee et al.

(10) Patent No.: US 8,237,589 B2
(45) Date of Patent: Aug. 7, 2012

(54) ADJUSTING SYSTEM AND METHOD FOR TRAFFIC LIGHT

(75) Inventors: Hou-Hsien Lee, Taipei Hsien (TW); Chang-Jung Lee, Taipei Hsien (TW); Chih-Ping Lo, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 420 days.

(21) Appl. No.: 12/540,350

(22) Filed: Aug. 12, 2009

(65) Prior Publication Data

US 2010/0321210 A1 Dec. 23, 2010

(30) Foreign Application Priority Data

Jun. 17, 2009 (CN) ..... 2009 1 0303331

(51) Int. Cl.
*G08G 1/07* (2006.01)

(52) U.S. Cl. ..... 340/917; 340/920; 340/916; 340/907

(58) Field of Classification Search ..... 340/917
See application file for complete search history.

(56) References Cited

U.S. PATENT DOCUMENTS

| | | | | |
|---|---|---|---|---|
| 7,825,829 | B2 * | 11/2010 | Madsen | 340/937 |
| 2002/0140577 | A1 * | 10/2002 | Kavner | 340/933 |
| 2003/0190058 | A1 * | 10/2003 | Jun et al. | 382/104 |
| 2009/0322561 | A1 * | 12/2009 | Morioka et al. | 340/907 |

FOREIGN PATENT DOCUMENTS

CN 2775768 Y 4/2006

* cited by examiner

*Primary Examiner* — George Bugg
*Assistant Examiner* — Kerri McNally
(74) *Attorney, Agent, or Firm* — Altis Law Group, Inc.

(57) ABSTRACT

An adjusting system for traffic lights includes a number of image capture units, a processing unit, and a storage system. The number image capture units capture a number of car images. The storage system examines the number of car images to find license plates in each car image, counts the number of the cars, obtains the status of the traffic lights according to the number of the cars, and manages status of the traffic lights correspondingly.

8 Claims, 5 Drawing Sheets

ADJUSTING SYSTEM AND METHOD FOR TRAFFIC LIGHT

BACKGROUND

1. Technical Field

The present disclosure relates to traffic lights, and more particularly to an adjusting system and an adjusting method for traffic lights.

2. Description of Related Art

Managing traffic flow of busy roadways is an extremely complex task. In complicated areas, traffic flow at each time in a day may be different. As a result, traffic lights may not be adjusted to help control the traffic flow effectively.

DETAILED DESCRIPTION

Figure 1:
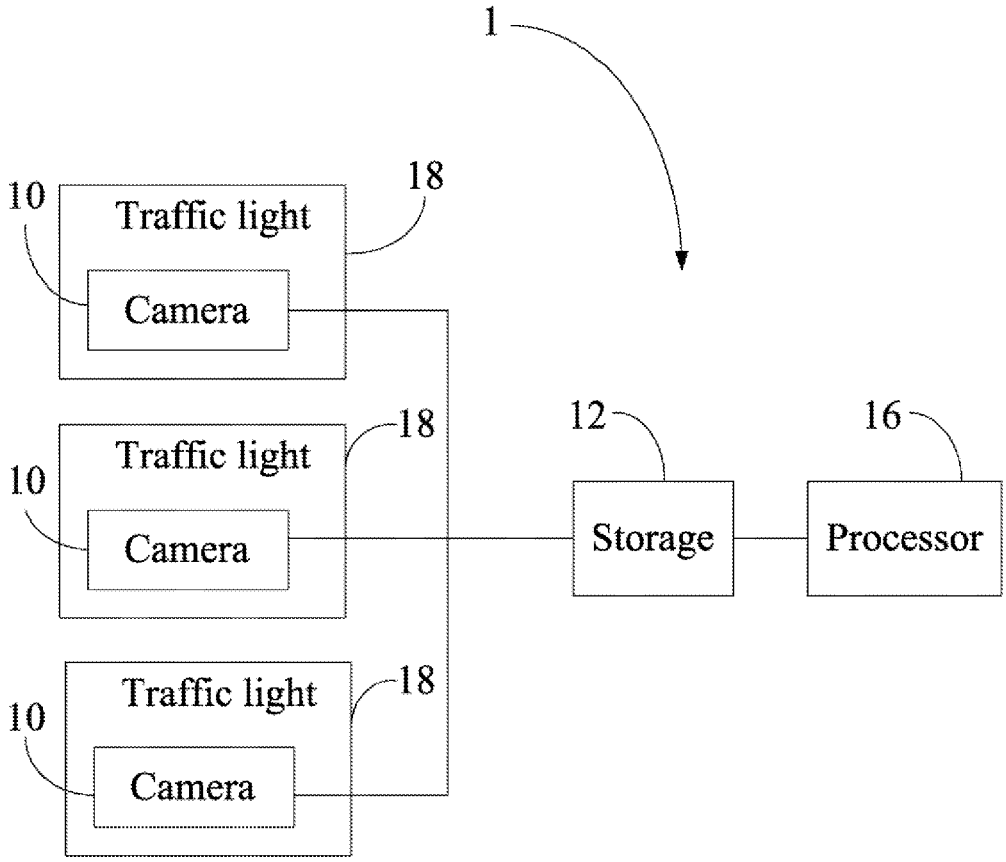
FIG. 1 is a schematic block diagram of an exemplary embodiment of an adjusting system for traffic lights, the adjusting system includes a storage.

Referring to FIG. 1, an exemplary embodiment of an adjusting system 1 includes a plurality of image capture units, such as a plurality of cameras 10, a storage 12, and a processor 16. The plurality of cameras 10 are disposed on a plurality of traffic lights 18, and coupled to the storage 12. The storage 12 is further coupled to the processor 16 and the plurality of traffic lights 18. The adjusting system 1 is operable to adjust status of the plurality of traffic lights 18.

Figure 2:
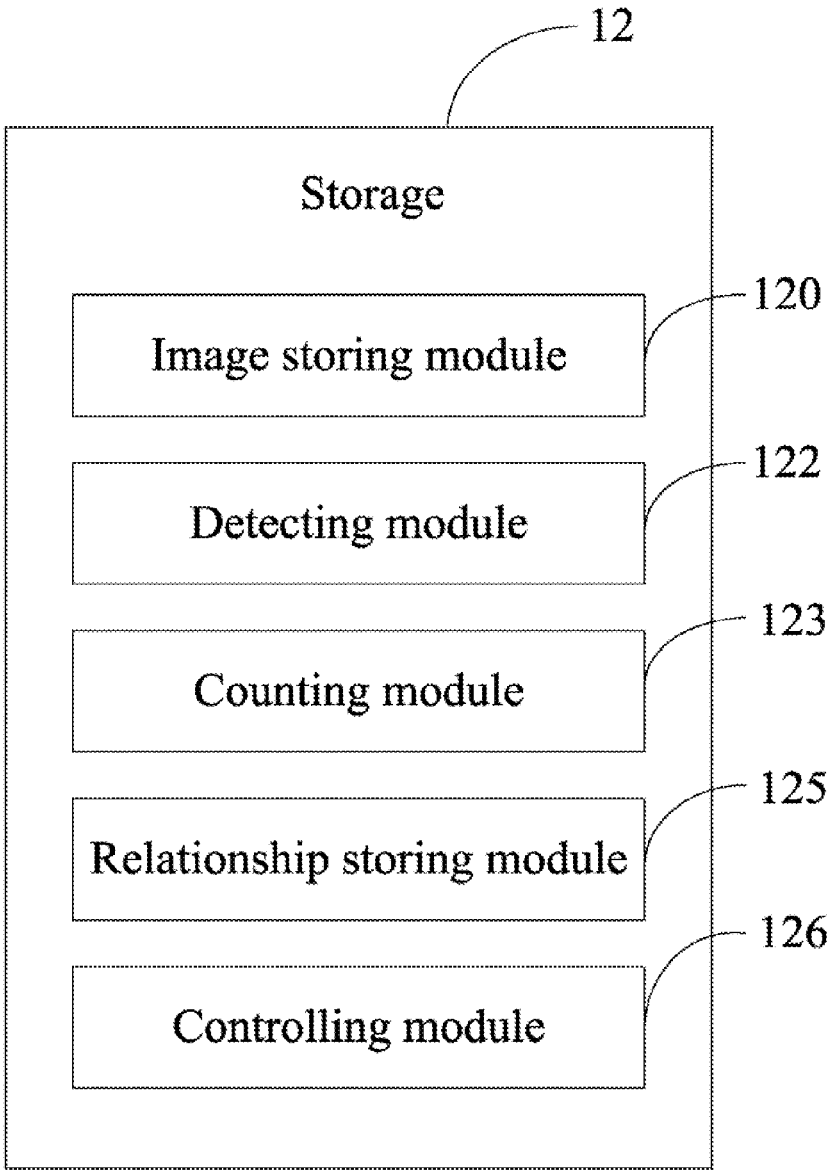
FIG. 2 is a schematic block diagram of the storage of FIG. 1.

Referring to FIG. 2, the storage 12 includes an image storing module 120, a detecting module 122, a counting module 123, a relationship storing module 125, and a controlling module 126. The detecting module 122, the counting module 123, and the controlling module 126 may include one or more computerized instructions and are executed by the processor 16.

Figure 3:
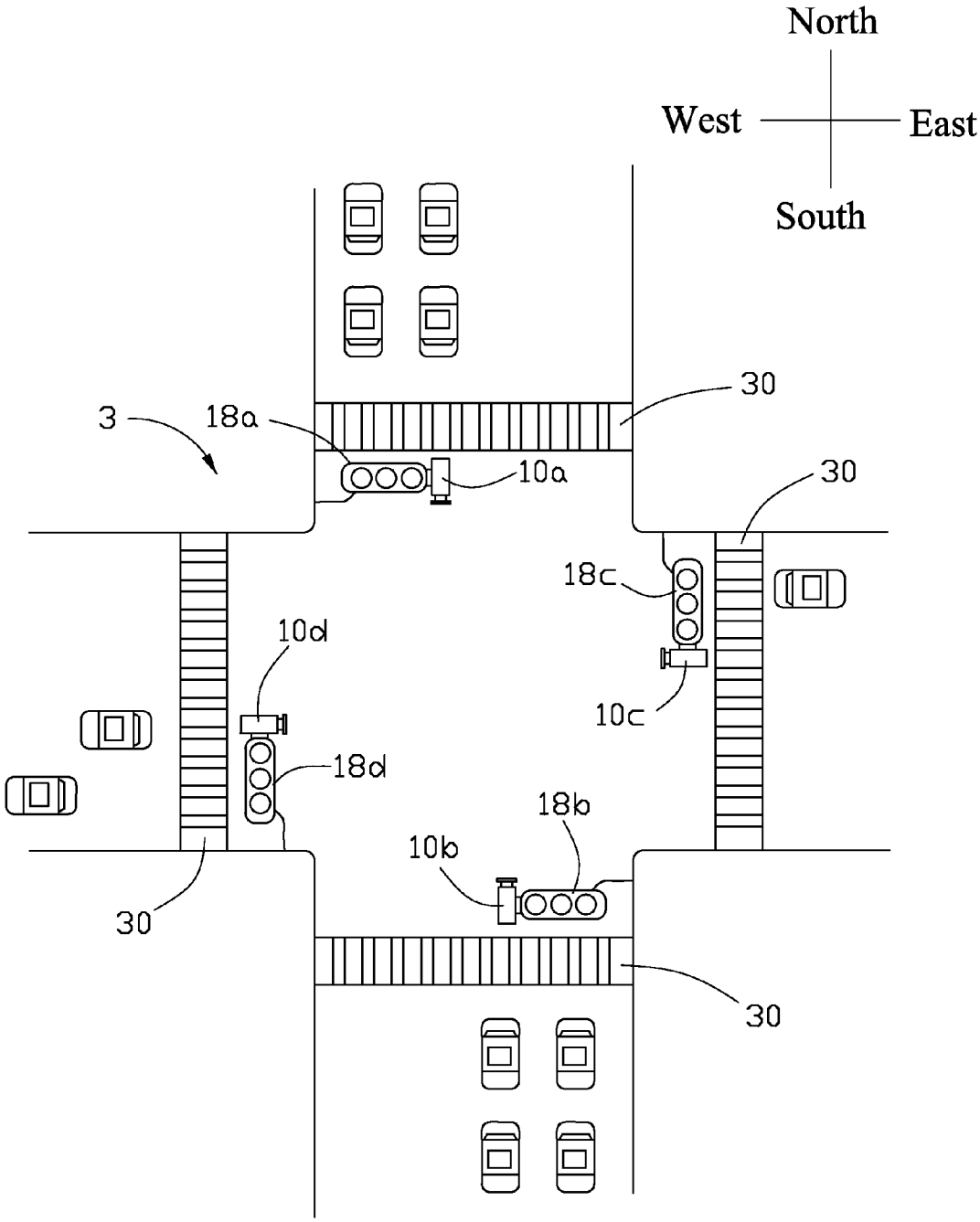
FIG. 3 is a schematic diagram of traffic status at an intersection.

Referring to FIG. 3, the plurality of traffic lights 18 include traffic lights 18*a*, 18*b*, 18*c*, and 18*d* located at an intersection 3. The plurality of cameras 10 includes 10*a*, 10*b*, 10*c*, and 10*d* disposed on the plurality of traffic lights 18*a*, 18*b*, 18*c*, and 18*d* to capture car images correspondingly. It can be understood that car images are images of one or more cars which are driving through the intersection 3.

The car images are stored in the image storing module 120.

The detecting module 122 examines the car images stored in the image storing module 120 to find characters, such as those on license plates, in the car images. It can be understood that the detecting module 122 uses well known recognition technology to find license plates in the car images.

The counting module 123 receives the license plates in the car images, and counts a number of cars to each direction of the intersection 3. It can be understood that one license plate denotes one car to a direction. The directions of the intersection 3 of FIG. 3 may include an eastern direction, a southern direction, a western direction, and a northern direction. For example, two cars are driving to the east. One car is driving to the west. Four cars are driving to the south and north respectively in FIG. 3.

The relationship storing module 125 stores a plurality of relationships between numbers of the cars and status of the traffic lights 18 correspondingly. For example, upon the condition that the number of cars to the south plus to the north is ten and the number of cars to the east plus to the west is five, status of the traffic lights 18 is that the traffic lights 18*a* and 18*b* are green for 120 seconds, and the traffic lights 18*c* and 18*d* are green for 100 seconds. In other words, cars at the intersection 3 can have the green light to drive south or north for 120 seconds, then east and west for 100 seconds.

The controlling module 126 receives the number of cars to each direction of the intersection 3, and obtains the status of the traffic lights 18 according to the relationship storing module 125. The controlling module 126 further manages status of the traffic lights 18 correspondingly. For example, if the counting module 123 counts a number of cars to the east plus to the west of the intersection 3 is 5, and a number of cars to the north plus to the south of the intersection 3 is 10, the controlling module 126 manages the traffic lights 18*a* and 18*b* to be green for 120 seconds, and then the traffic lights 18*c* and 18*d* to be green for 100 seconds.

In other embodiments, the relationship storing module 125 may store a number of the cars to each direction for various moments. The controlling module 126 receives the number of the cars to each direction of the intersection 3, and compares the number of the cars to each direction of the intersection 3 at this moment with the number of the cars to each direction of the intersection 3 at a previous moment. The controlling module 126 further manages status of the traffic lights 18 according to the comparing result. For example, the number of cars to the east plus to the west of the intersection 3 is 3, the number of cars to the north plus to the south of the intersection 3 is 8, and the status of the traffic lights 18 is that the traffic lights 18*a* and 18*b* are green for 100 seconds, the traffic lights 18*c* and 18*d* are green for 80 seconds at the previous moment. In addition, the counting module 123 counts the number of cars to the east plus to the west of the intersection 3 is 5, and the number of cars to the north plus to the south of the intersection 3 is 10 at this moment. Therefore, the controlling module 126 adds the time of the traffic lights 18 accordingly. For example, the controlling module 126 manages the traffic lights 18*a* and 18*b* to be green for 120 seconds, and the traffic lights 18*c* and 18*d* to be green for 100 seconds at this moment.

In addition, more cameras 10 may be set on crosswalks 30 at the intersection 3. The cameras 10 capture pedestrian images at the crosswalks 30. The detecting module 122 further detects faces in the pedestrian images. The counting module 123 further counts a number of pedestrians to each direction of the crosswalks 30. The relationship storing module 125 further stores a plurality of relationship between a number of the pedestrians and status of the traffic lights 18 correspondingly. The controlling module 126 further manages status of the traffic lights 18 according to the number of pedestrians to each direction of the crosswalks 30 and the relationship stored in the relationship storing module 125.

Figure 4:
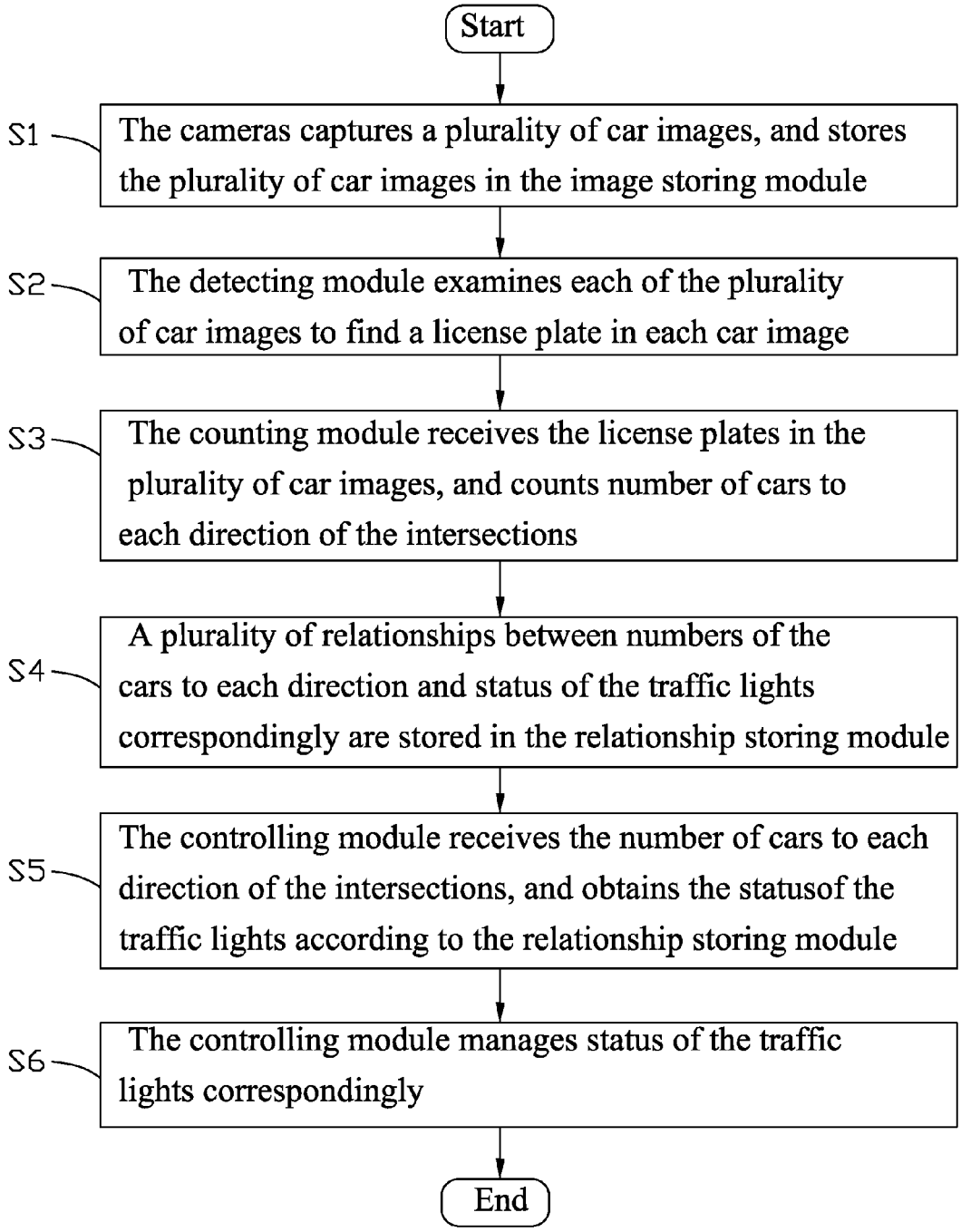
FIG. 4 is a flowchart of a first embodiment of an adjusting method for traffic lights.

Referring to FIG. 4, a first exemplary embodiment of an adjusting method includes the following steps.

In step S1, the plurality of cameras 10 capture car images, and store the car images in the image storing module 120.

In step S2, the detecting module 182 examines each of the car images to find a license plate in each car image. It can be understood that the detecting module 122 uses a well known recognition technology to find the license plates in the car images.

In step S3, the counting module 123 receives the license plates in the car images, and counts a number of cars in each direction of the intersection 3. It can be understood that one license plate denotes one car in a direction. For example, referring FIG. 3, it can be known that two cars are driving to the east, one car is driving to the west, and four cars are driving to the south and north respectively via the counting module 123.

In step S4, a plurality of relationships between numbers of the cars to each directions and status of the traffic lights 18 correspondingly are stored in the relationship storing module 125. For example, upon the condition that the number of cars to the south plus to the north is ten and the number of cars to the east plus to the west is five, status of the traffic lights 18 is that the traffic lights 18*a* and 18*b* are green for 120 seconds, and the traffic lights 18*c* and 18*d* are green for 100 seconds.

In step S5, the controlling module 126 receives the number of cars to each direction of the intersection 3, and obtains the status of the traffic lights 18 according to the relationship storing module 125. For example, the counting module 123 counts a number of cars to the east plus to the west of the intersection 3 is 5, and a number of cars to the north plus to the south of the intersection 3 is 10, the status of the traffic lights 18 is that the traffic lights 18*a* and 18*b* are green for 120 seconds, and the traffic lights 18*c* and 18*d* are green for 100 seconds.

In step S6, the controlling module 126 further manages status of the traffic lights 18 correspondingly. For example, the controlling module 126 adjusts the traffic lights 18*a* and 18*b* to be green for 120 seconds, and the traffic lights 18*c* and 18*d* to be green for 100 seconds.

Figure 5:
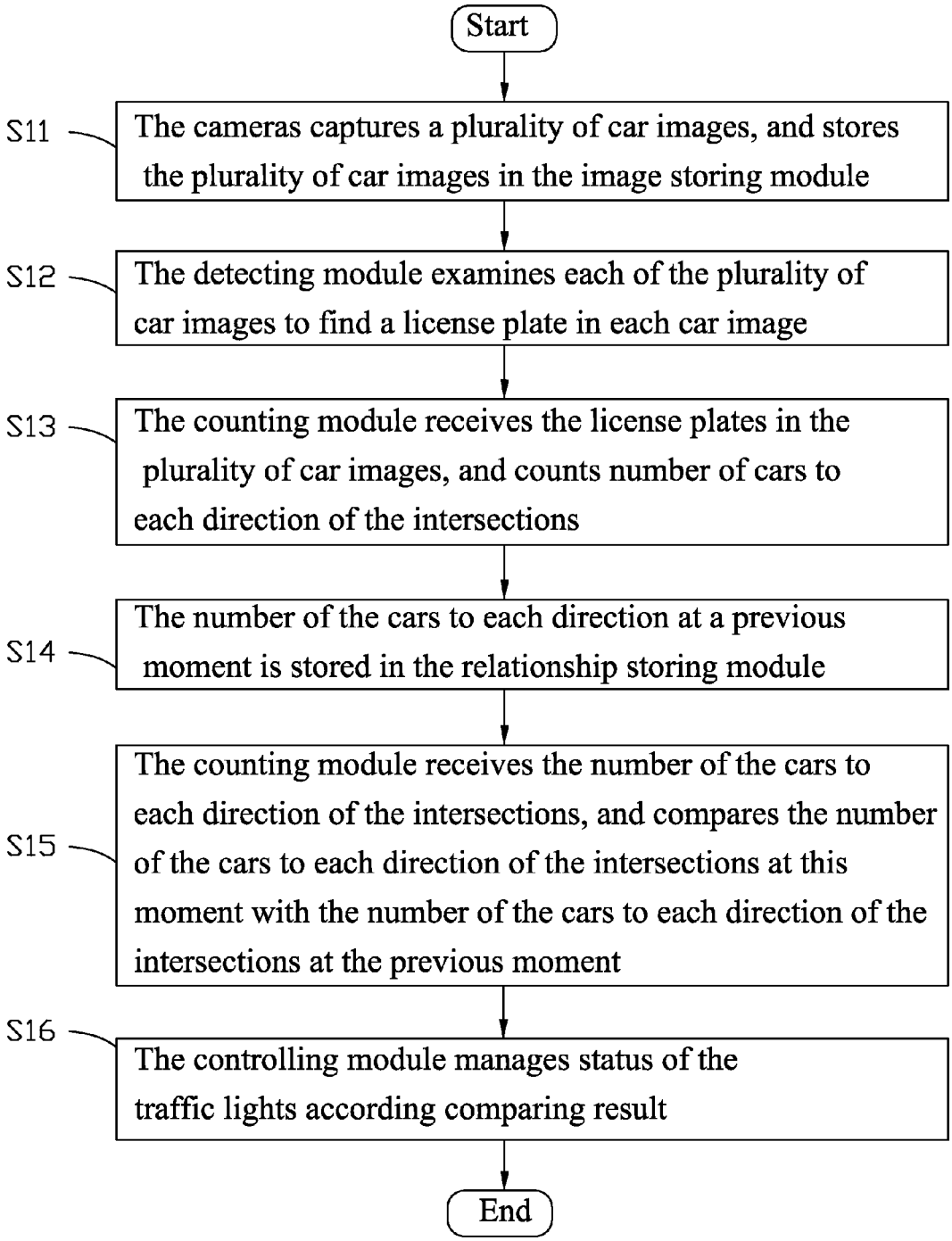
FIG. 5 is a flowchart of a second embodiment of an adjusting method for traffic lights.

Referring to FIG. 5, a second exemplary embodiment of an adjusting method includes the following steps.

In step S11, the plurality of cameras 10 capture car images, and store the car images in the image storing module 120.

In step S12, the detecting module 182 examines each of the car images to find a license plate in each car image. It can be understood that the detecting module 122 uses a well known recognition technology to find the license plates in the car images.

In step S13, the counting module 123 receives the license plates in the car images, and counts a number of cars to each direction of the intersection 3. It can be understood that one license plate denotes one car to one direction. For example, in FIG. 3, it can be known that two cars are driving to the east, one car is driving to the west, and four cars are driving to the south and north respectively via the counting module 123.

In step S14, the number of the cars to each direction at a previous moment is stored in the relationship storing module 125.

In Step S15, the counting module 123 receives the number of the cars to each direction of the intersection 3, and compares the number of the cars to each direction of the intersection 3 at this moment with the number of the cars to each direction of the intersection 3 at the previous moment.

In step S16, the controlling module 126 manages status of the traffic lights 18 according the comparing result. For example, the number of cars to the east direction plus to the west of the intersection 3 is 3, the number of cars to the north plus to the south of the intersection 3 is 8, and the status of the traffic lights 18 is that the traffic lights 18*a* and 18*b* are green for 100 seconds, the traffic lights 18*c* and 18*d* are green for 80 seconds at the previous moment. In addition, the counting module 123 counts the number of cars to the east plus to the west of the intersection 3 is 5, and the number of cars to the north plus to the south of the intersection 3 is 10 at this moment. Therefore, the controlling module 126 adds the time of the traffic lights 18 accordingly. For example, the controlling module 126 manages the traffic lights 18*a* and 18*b* to be green for 120 seconds, and the traffic lights 18*c* and 18*d* to be green for 100 seconds.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. An adjusting system for traffic lights, the adjusting system comprising:

a plurality of cameras to capture a plurality of car images;

a processor; and a storage connected to the processor and storing a plurality of computerized instructions to be executed by the processor, wherein the processor executes the computerized instructions stored in the storage to store the plurality of car images from the plurality of cameras, to examine each of the plurality of car images to find a license plate in each car image, to receive the license plates and count a number of the cars, to store a plurality of relationships between the number of the cars to each direction of an intersection and status of the traffic lights correspondingly, and to receive the number of cars in each direction of the intersection, obtain the status of the traffic lights according to the relationship storing module, and manage status of the traffic lights correspondingly.

2. The adjusting system of claim 1, wherein the plurality of cameras are to be located on the traffic lights.

3. The adjusting system of claim 1, wherein the processor further executes the computerized instructions stored in the storage to store the number of the cars in each direction for various moments, to receive the number of the cars in each direction of the intersection, to compare the number of the cars in each direction of the intersection at this moment with the number of the cars at each direction of the intersection at a previous moment, and to manage status of the traffic lights according to a comparing result.

4. An adjusting system comprising:

a plurality of cameras to capture a plurality of pedestrian images of a plurality of pedestrians at an intersection;

a processor; and a storage connected to the processor and storing one or more computerized instructions to be executed by the processor, wherein the processor executes the computerized instructions stored in the storage to store the plurality of pedestrian images from the plurality of cameras, to examine each of the plurality of pedestrian images to find a face in each pedestrian image, to store a plurality of relationships between a number of the plurality of pedestrians and status of traffic lights correspondingly, and to receive the number of the plurality of pedestrians in each direction of the intersection, obtain the status of the traffic lights according to the relationship storing module, and manage status of the traffic lights correspondingly.

5. The adjusting system of claim 4, wherein the plurality of cameras are to be located on the traffic lights.

6. The adjusting system of claim 4, wherein the processor further executes the computerized instructions stored in the storage to store the number of the plurality of pedestrians at each direction for various moments, to receive the number of the plurality of pedestrians in each direction of intersection, to compare the number of the plurality of pedestrians in each direction of the intersection at this moment with the number of the plurality of pedestrians in each direction of the intersection at a previous moment, and to manage status of the traffic lights according to a comparing result.

7. An adjusting method for traffic lights, the adjusting method comprising:

capturing a plurality of car images at an intersection, and storing the plurality of car images in a storage;

examining each of the plurality of car images to find a license plate in each car image;

receiving the license plates in the plurality of car images, and counting a number of cars in each direction of the intersection;

receiving the number of cars in each direction of the intersection, and obtaining the status of the traffic lights; and managing status of the traffic lights correspondingly.

8. The adjusting method of claim 7, further comprising:

capturing a plurality of pedestrian images, and storing the plurality of pedestrian images in the storage;

examining each of the plurality of pedestrian images to find a face in each pedestrian image;

receiving the faces in the plurality of pedestrian images, and counting a number of pedestrians in each direction of the intersection;

receiving the number of pedestrians in each direction of the intersection, and obtaining the status of the traffic lights; and managing status of the traffic lights correspondingly.

* * * * *